US007153157B2

(12) United States Patent
Robinson et al.

(10) Patent No.: US 7,153,157 B2
(45) Date of Patent: Dec. 26, 2006

(54) TERMINAL BLOCK JUMPER

(75) Inventors: Darrell Robinson, Highland, MI (US); Karl R. Loehr, Commerce Township, MI (US)

(73) Assignee: Ekstrom Industries, Inc., Farmington Hills, MI (US)

( * ) Notice: Subject to any disclaimer, the term of this patent is extended or adjusted under 35 U.S.C. 154(b) by 0 days.

(21) Appl. No.: 11/039,545

(22) Filed: Jan. 19, 2005

(65) Prior Publication Data

US 2006/0160413 A1 Jul. 20, 2006

(51) Int. Cl.
*H01R 31/08* (2006.01)

(52) U.S. Cl. ..... 439/508; 439/510; 439/512; 439/517; 439/487

(58) Field of Classification Search ..... 439/508, 439/510, 507, 509, 511, 513, 514, 517, 487, 439/737, 739, 512; 307/147
See application file for complete search history.

(56) References Cited

U.S. PATENT DOCUMENTS 4,162,815 A * 7/1979 Fleischhacker ..... 439/509
4,516,817 A * 5/1985 Deters ..... 439/513
4,547,036 A * 10/1985 Keglewitsch et al. ..... 439/680
4,553,802 A * 11/1985 Ruehl ..... 439/266
4,659,158 A * 4/1987 Sakamoto et al. ..... 439/507
4,883,430 A * 11/1989 Siemon et al. ..... 439/510
4,955,823 A * 9/1990 Luzzi ..... 439/507
5,609,493 A * 3/1997 Cheng et al. ..... 439/157
5,620,337 A * 4/1997 Pruehs ..... 439/508
5,879,203 A * 3/1999 Egle et al. ..... 439/830
6,099,347 A * 8/2000 Hoyt et al. ..... 439/510
6,402,548 B1 * 6/2002 Ruiz et al. ..... 439/507
6,663,405 B1 12/2003 Robinson et al.
6,663,422 B1 12/2003 Robinson et al.
2003/0008551 A1 * 1/2003 Chang ..... 439/512
2005/0239325 A1 * 10/2005 Cook et al. ..... 439/517

OTHER PUBLICATIONS

Marwell Corporation; Safety Disconnect for the K-7; Marwell News, May 2001.
Marwell Corporation; Convert Landis & Gyr K-7 to 2S Meter; Marwell News, May 2003.
Meter Devices Co., Inc.,( a sister company to Ekstorm Instustries, Inc., the assignee of the above-identified application, both of which are part of E.J. Brooks, Co., Livingston, NJ); 13-Terminal Ringless Transocket; Schematic; Feb. 1999.
A Marwell K-style watthour meter socket adapter for plug-in watthour meters in a K-series socket is shown in Figs. A, B and C.

* cited by examiner

*Primary Examiner*—Gary F. Paumen
(74) *Attorney, Agent, or Firm*—Young Basile Hanlon McFarlane & Helmholdt, P.C.

(57) ABSTRACT

An electrically insulated body carries one of more jaw members which are mountable over threaded terminals in a meter socket to provide a bypass connection between line and load socket terminals to enable a watthour meter to be removed and reinstalled relative to the socket. In another aspect, the jaw members are coupled to an electrically conductive member. A handle extends from the conductive member.

19 Claims, 9 Drawing Sheets

FIG - 8
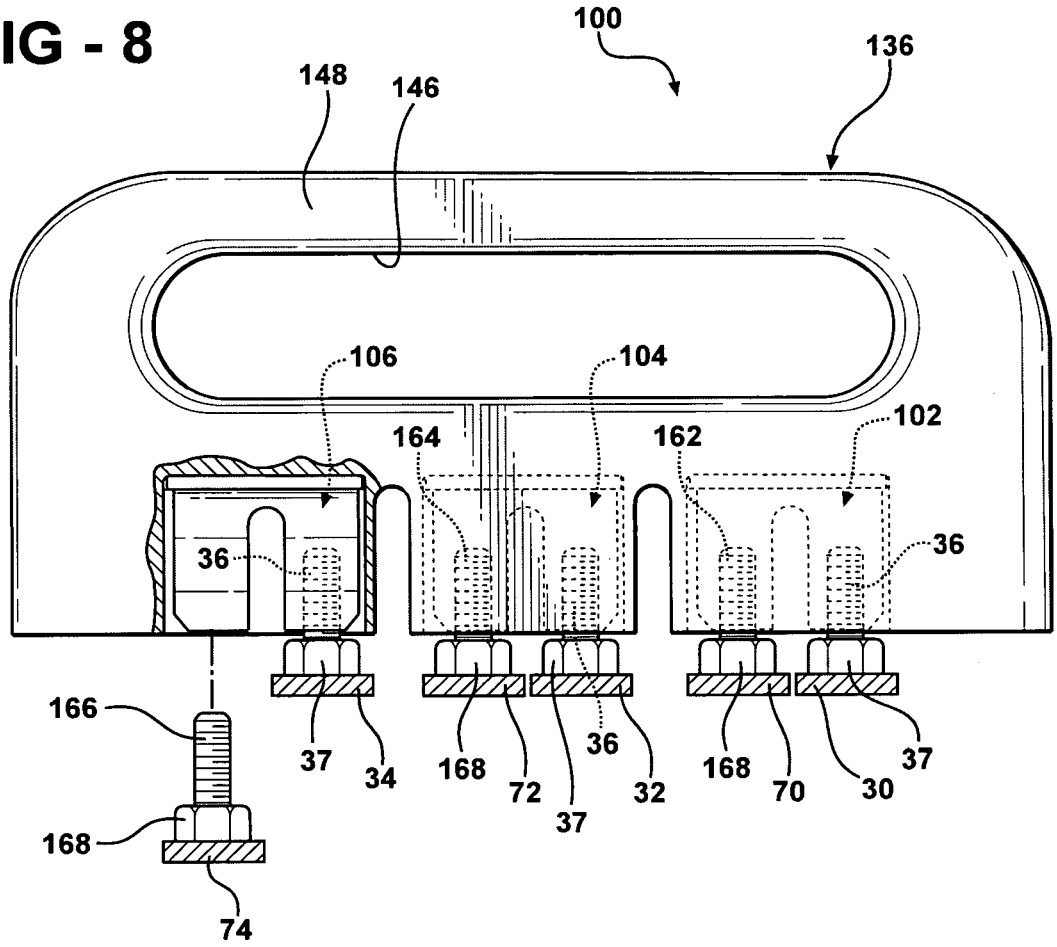
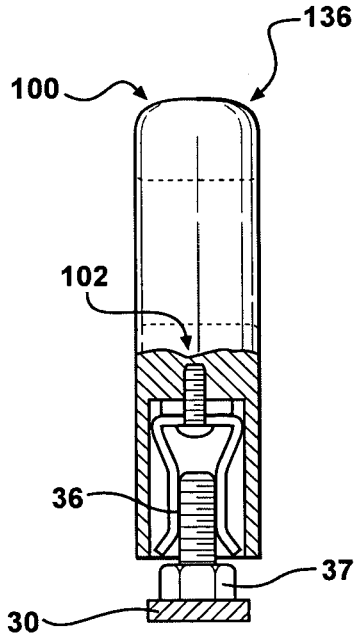
FIG - 9

TERMINAL BLOCK JUMPER

BACKGROUND

The present invention relates, in general, to electrical power metering apparatus and, specifically, to electrical watthour meters and watthour meter sockets.

In the electric utility industry, plug-in, socket-type watthour meters are commonly employed to measure electric power consumption at a residential or commercial building establishment. A socket is mounted on a wall of the residence or building and contains terminals which are connected to electric line and electric load conductors. The terminals are also connected to internal conductors within the socket which extend to jaw contacts positioned to receive the blade terminals of a plug-on watthour meter to complete an electric circuit through the watthour meter between the line and load terminals and the conductors.

One type of meter socket has a ring-type cover which includes an outwardly projecting, annular mounting flange surrounding an opening in the cover through which the blade terminals of a watthour meter extend. The mounting flange is sized to mate with a complementary formed mounting flange on the bottom of the watthour meter.

In high power applications, current levels exceed the ratings of commonly available watthour meters. In these applications, current transformers are placed around the incoming line conductors and connected to watthour meter receiving jaw contacts to enable watthour meters to measure load current and provide a scaled power measurement.

A special socket, referred to as a K-series socket, is shown in FIGS. 1–4. The socket is designed for single or three-phase power and is designed to carry current up to 400 amps. Rigid bus bar terminals are provided in the upper portion of the socket for receiving the line conductors. Similar plate-like bus bar terminals are mounted at the bottom of the socket for receiving the load conductors. A single mounting fastener, such as a bolt, is provided on each load bus bar for receiving a rigid load bus bar extending from a watthour meter which is mountable in the socket. Similar mounting fasteners, such as bolts, are mounted in a first row on the upper line power bus bars for receiving a separate line bus bar extending from a watthour meter.

As also shown in FIGS. 1–4, shorting bus bars extend between each line bus bar and the corresponding load bus bar provide a bypass power connection from the power distribution line network to the individual load distribution network in a building.

As is evident from FIGS. 1–4, a specially designed watthour meter with rigid bus bars is necessary for mounting in the K-series socket in both the power measurement and non-power measurement positions.

When it is necessary to remove the meter from the socket for replacement or repair, jumpers are connected between at least each line bus bar and each associated line bypass bus bar to prevent the loss of electrical service when the meter is removed from the socket. The nuts on the bus bar and bypass bus bar studs are loosened and a slotted conductive plate which is mounted on one end of an electrically insulated rod shaped handle is inserted between the nuts and bus bars before the nuts are re-tightened. The nuts connecting the meter bus bars to the line and load bus bar studs are removed to enable the meter to be removed from the socket and a new meter installed. After the new meter is installed, the jumper is removed by a reverse operation from that described above. This is a time consuming process.

The installation and removal of the jumpers poses a safety hazzard to the utility service person since the meter is installed and removed from the socket under live power conditions. The service person must use a nut driver or socket wrench to loosen and tighten the stud nuts in order to install and remove the jumper. Accidental dropping of the wrench or nut driver can cause the wrench or nut driver to fall into the socket and possibly short across the bus bars creating a hazardous short which could damage the socket and cause injury to the service person.

It would be desirable to provide a terminal jumper which can be installed in and removed from the socket in less time and under safer conditions than previous socket jumpers.

SUMMARY OF THE INVENTION

In one aspect, a terminal block jumper is usable in an electric power service apparatus including line and load threaded studs or terminals for receiving electric power line and load conductors. The jumper includes electrically conductive jaw means for plug-on connection to at least two spaced terminals or studs electrically coupled to the line and/or load bus bars. The jumper may also include handle means which carries the jaw means.

The jaw means includes a pair of resiliently movable spring jaw members which may be integrally coupled at one end by a base leg or separately joined to an electrically conductive member, such as a block or rod.

Mounting means are employed for fixing the jaw means in the handle means. The mounting means may include a fastener extendable through each jaw means into the handle means.

The handle means may be a body formed of an electrically insulating material. At least one cavity is formed in the body, opening from one end, for receiving the jaw means.

A hand grip means may also be formed in the body for facilitating movement of the jumper. The hand grip means may include an opening in the body for receiving a user's hand and an adjacent bar.

A heat sink may optionally be disposed in contact with the jaw means to dissipate heat from the jaw means to enable the jaw means to carry higher current. The heat sink may be mounted in the handle and disposed in contact with the jaw means.

The present invention also discloses a method of temporarily connecting two threaded studs in an electrical service power apparatus used to receive fasteners to secure line and load power conducting members. The method comprises the step of providing an electrically conductive jumper with two spaced electrically conductive jaws plug-on engagable with the threaded studs.

The method also includes the step of providing a handle, coupled to the jaws, for manipulating the jumper.

The terminal block jumper provides a safe and quickly installable and removable jumper to enable a meter to be safely removed from a socket or housing and a new meter installed while minimizing the exposure of the utility service person to the danger of contact with live electrical power. The terminal block jumper is also mountable on and removable from the threaded studs in the electrical service apparatus without damaging the studs.

BRIEF DESCRIPTION OF THE DRAWING

The various features, advantages and other uses of the present invention will become more apparent by referring to the following detailed description and drawing in which:

FIG. 8 is a partial, cross-sectional view showing the mounting of the jumper of FIGS. 5–7 on the threaded studs shown in FIG. 1;

FIG. 9 is a side elevational view of FIG. 8 showing the mounting of the jumper on the studs;

DETAILED DESCRIPTION

Figure 1:
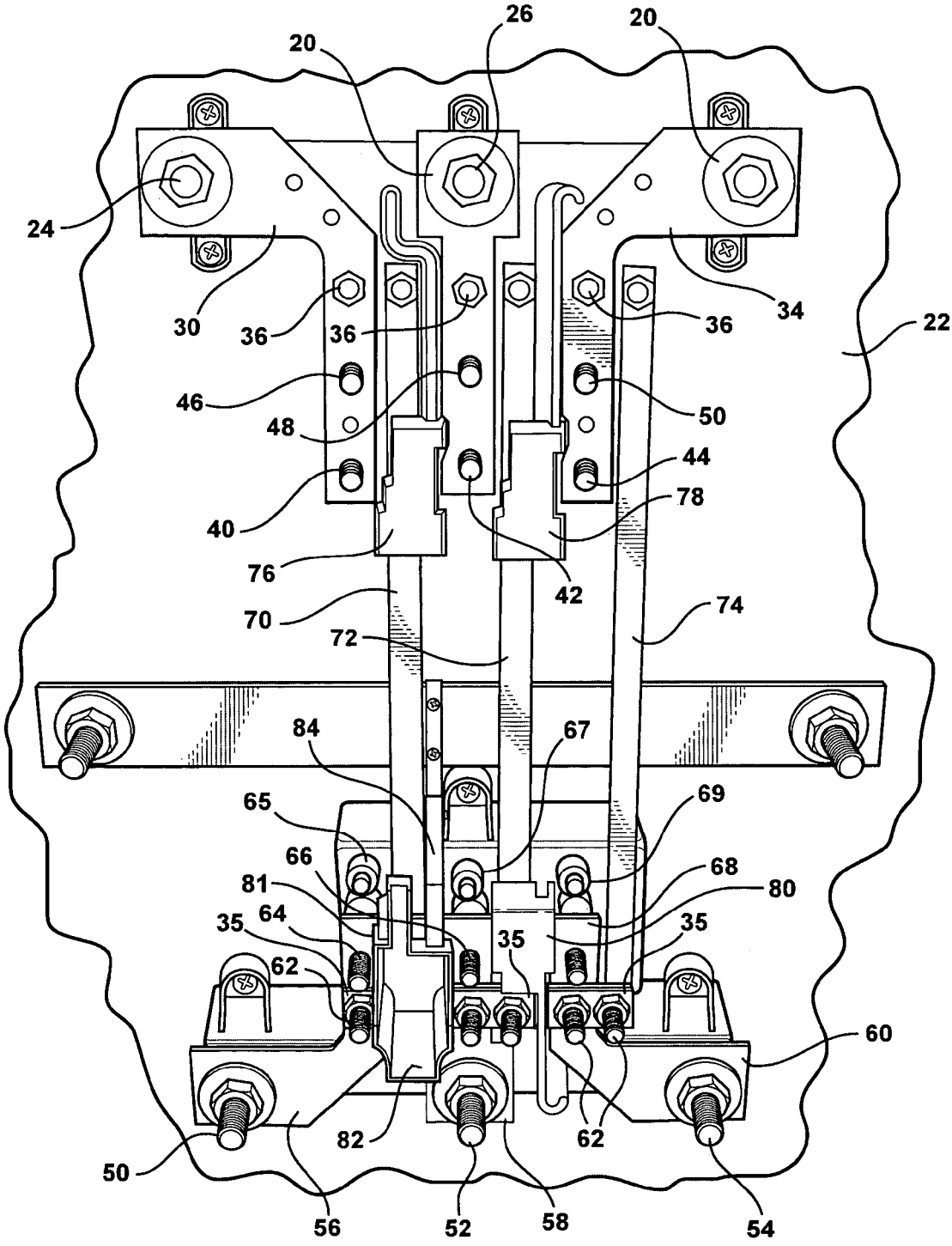
FIG - 1 PRIOR ART
FIG. 1 is a perspective view of a prior art K-series meter socket, without a watthour meter.

For clarity in understanding the features and advantages of the present watthour meter socket adapter, a description will be first presented with reference to FIGS. 1–4 of a prior art K-series watthour meter socket designed for receiving a K-series watthour meter.

As shown in FIGS. 1–4, a K-series meter socket, which generally in the form of a closed housing having a removable cover, as described hereafter, includes a base plate 22 on which three line terminals 24, 26 and 28 for the exemplary three-phase power application are mounted. It will be understood that only two terminals, such as terminals 24 and 26, are necessary for single phase applications. The terminals 24, 26 and 28 are mounted on the base plate 22. The terminals 24, 26 and 28 provide a connection point for power distribution line conductors, not shown, which are mounted and secured in place over the terminals 24, 26 and 28.

Individual plate-like line bus bars 30, 32 and 34 are connected at one end to the terminals 24, 26 and 28, respectively, and are secured to the base plate 22 by fasteners 36. The bus bars 30, 32 and 34 each support a first fastener, such as threaded studs 40, 42 and 44, respectively. The studs 40, 42 and 44 are arranged in a first row hereafter defined as a first meter mounting position in which the studs 40, 42 and 44 are positioned for receiving the line bus bars of a watthour meter in a power measuring or metering position.

A second row of fasteners, such as threaded studs 46, 48 and 50, are also mounted on and extend from the bus bars 30, 32 and 34, respectively. The studs 46, 48 and 50 are arranged in a second row hereafter referred to as an out of service meter position.

Similar load connections are also mounted on the base plate 22 and include terminals 50, 52 and 54 which provide a terminal or connection point for distribution load conductors, not shown. Bus bars 56, 58 and 60 are also mounted on the base plate 22 and are connected at one end to the terminals 52 and 54 respectively. Each bus bar 56, 58 and 60 is secured by fasteners 62 to the base plate 22. Meter mounting fasteners, such as threaded studs 64, 66 and 58, are respectively carried on each bus bar 56, 58 and 60 and extend therefrom for receiving watthour meter load conductors or bus bars in a power metering position.

Jumper bars or straps 70, 72 and 74 extend between the individual line bus bars 30, 32 and 34 and the load bus bars 56, 58 and 60 and are connected to the load bus bars 56, 58 and 60 by jumpers 35 mounted over studs 62 fixed on the bus bars on the plate 22.

The line ends of the jumper bars 70, 72 and 74 are fixed to the plate 22 by threaded studs 162, 164 and 166 and nuts 168. The studs 160, 164 and 166 can be in-line with the studs 36.

Line insulator blocks 76 and 78 are mounted between adjacent line bus bars 30, 32 and 34 to provide sufficient electrical insulation between the high current carrying bus bars 30, 32 and 34. A similar load insulator block 80 is mounted between two of the load bus bars 58 and 60. A ground insulator bracket 82 is mounted between the load bus bars 56 and 58 and provides a support and insulator for a ground terminal assembly 84 mounted in a meter ground terminal position for receiving a ground terminal on a watthour meter.

Figure 2:
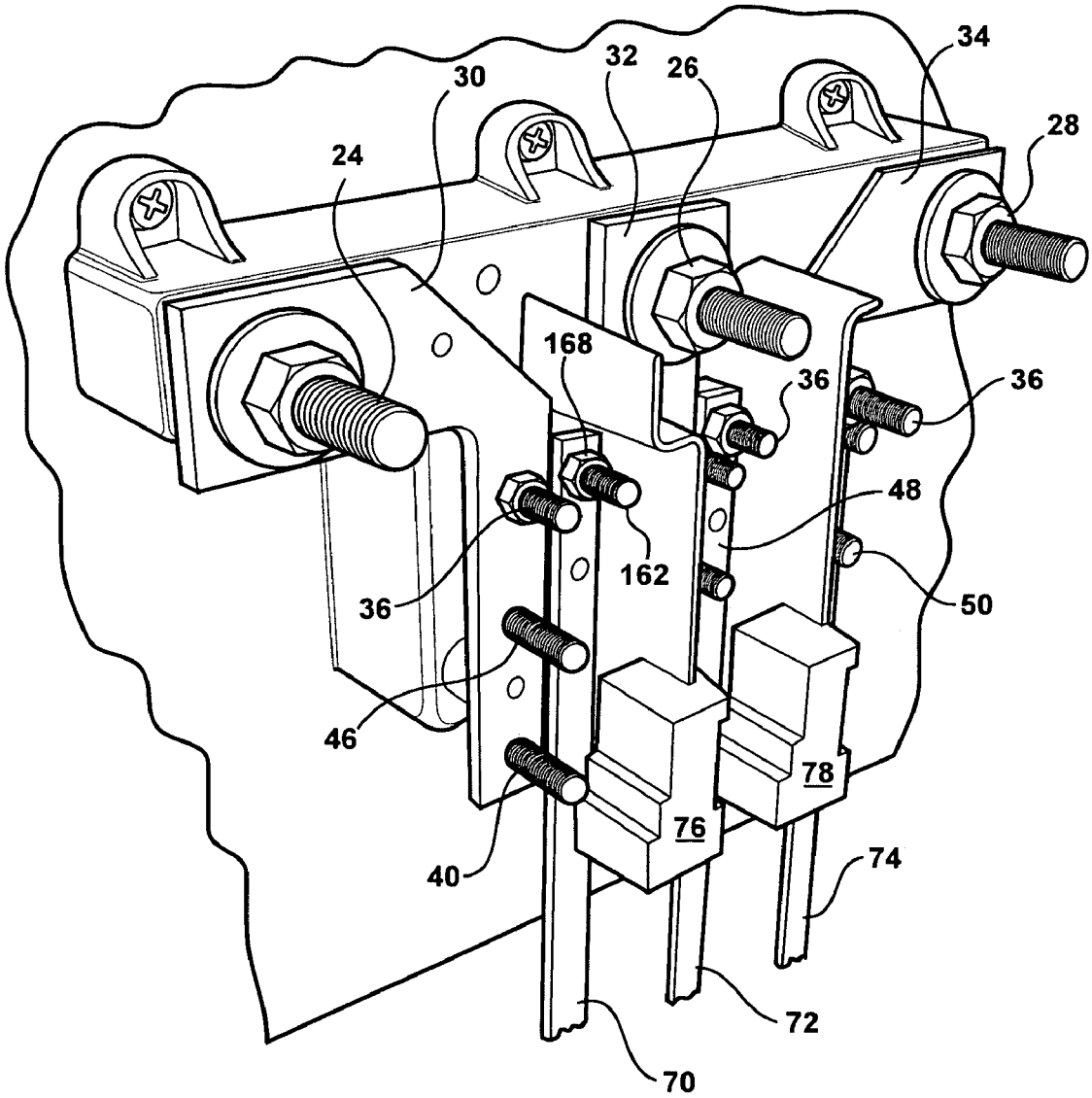
FIG - 2 PRIOR ART
FIG. 2 is an enlarged, perspective view of the line terminals in the socket shown in FIG. 1.
Figure 3:
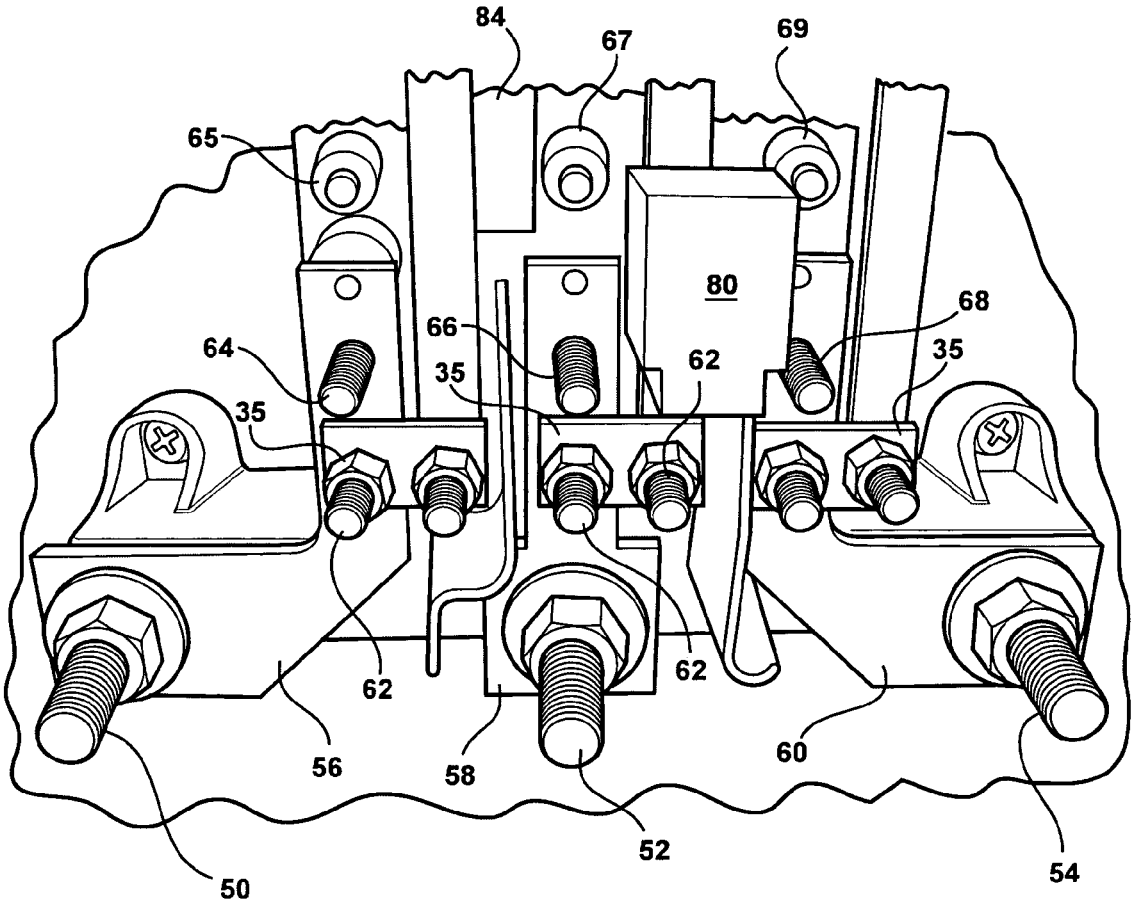
FIG - 3 PRIOR ART
FIG. 3 is a partial, enlarged perspective view of the load terminals in the socket shown in FIG. 1.
Figure 4:
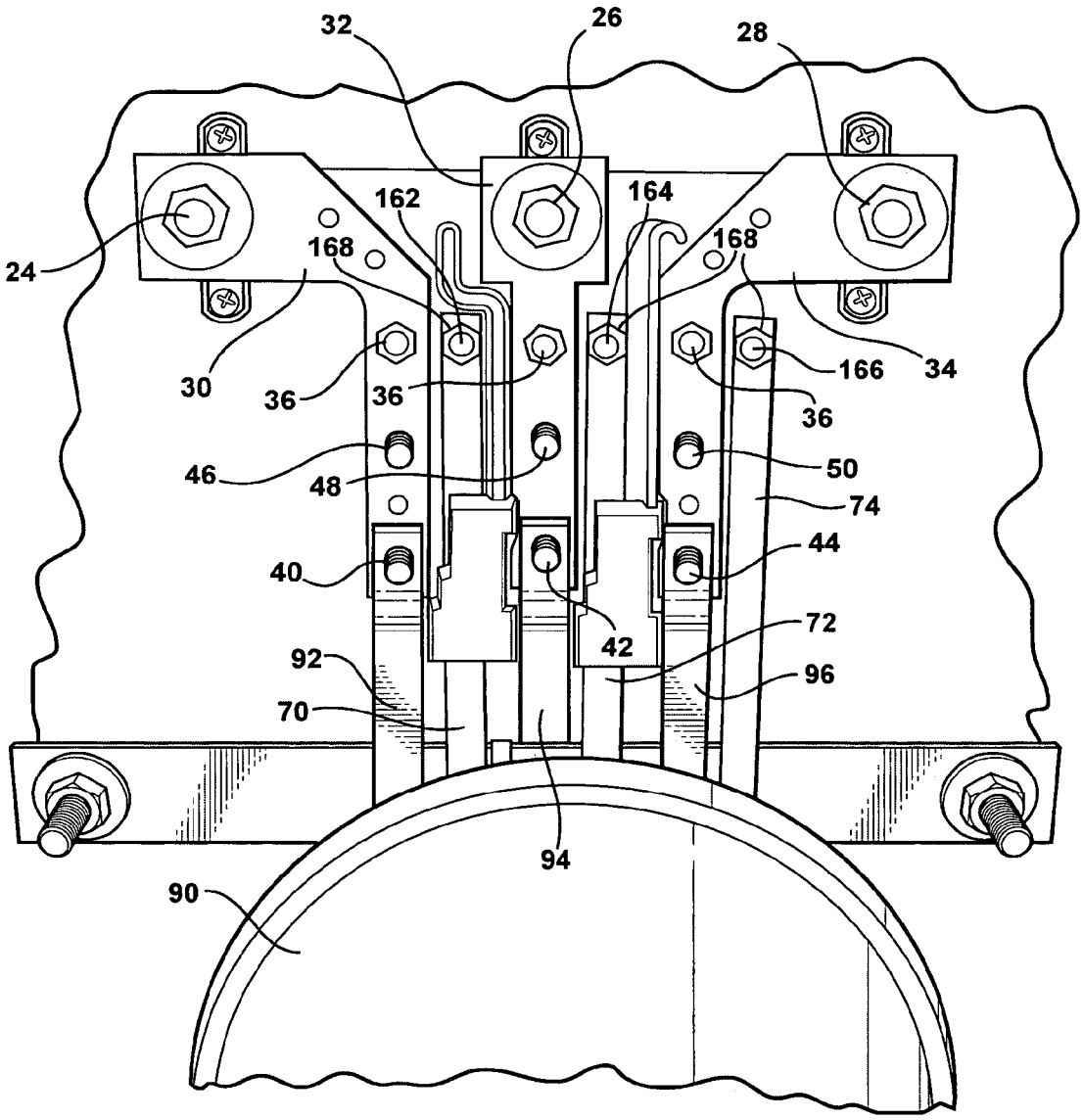
FIG - 4 PRIOR ART
FIG. 4 is a partial, enlarged perspective view showing the mounting of the line bus bars of a watthour meter in the socket shown in FIG. 1.
Figure 5:
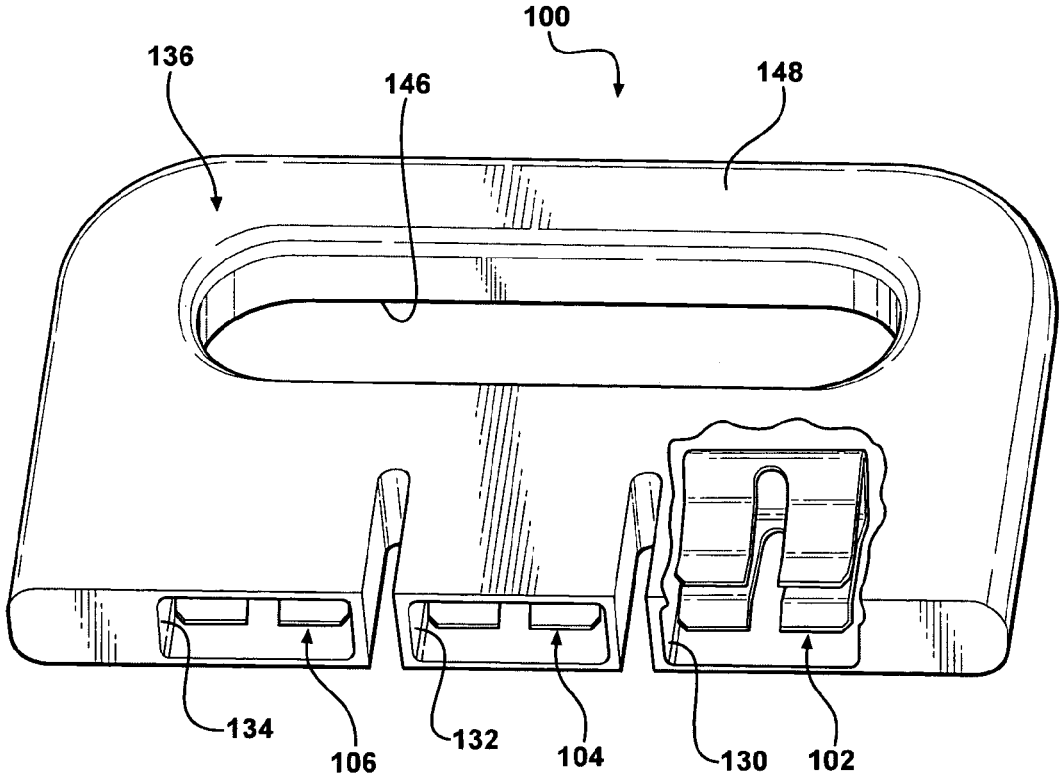
FIG. 5 is a partially broken away, perspective view of one aspect of a terminal block jumper.
Figure 6:
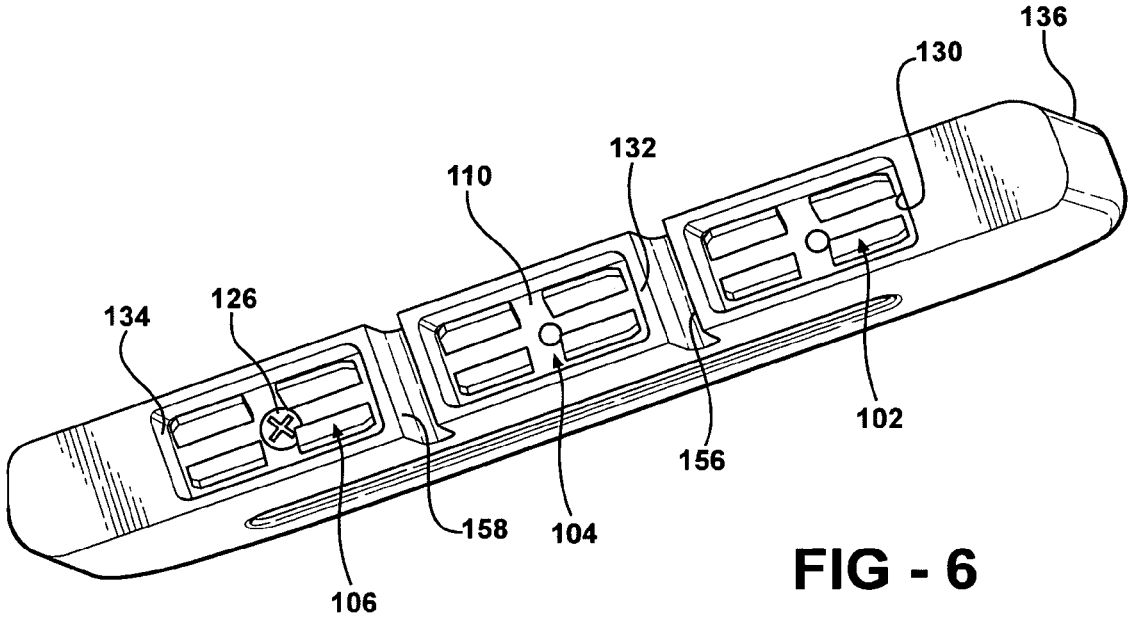
FIG. 6 is a bottom perspective view of the jumper shown in FIG. 5.

As shown in FIG. 4, a K-series watthour meter 90 has, for the exemplary three-phase power application shown in FIGS. 1–3, three separate line conductors 92, 94 and 96, each in the form of a rigid bus bar having sufficient cross-section to carry up to 400 amps of current, for example. The bus bars 92, 94 and 96 extend outward generally parallel to the bottom wall of the meter 90, and then bend away from the bottom wall of the meter 90 before transitioning to an outwardly extending flange end generally parallel to the bottom wall of the meter 90. Apertures are formed in the end flanges for mounting over the line mounting fasteners 40, 42 and 44 or 46, 48 and 50 in the first and second rows of fasteners.

Referring now to FIGS. 5–8, there is depicted one aspect of a terminal block jumper 100 which is configured for jumpering one line or load terminal or bus bar and one bypass terminal or bar in the meter socket shown in FIGS. 1–4 to provide a bypass power connection between the line and load bus bars to enable safe removal and reinstallation of a watthour meter out of or into the socket.

It will be understood that although the terminal block jumper 100 is depicted for providing three parallel jumpers in a polyphase meter socket, the terminal block jumper 100 could also be configured for single phase jumpering including one or more jumpers.

Figure 7:
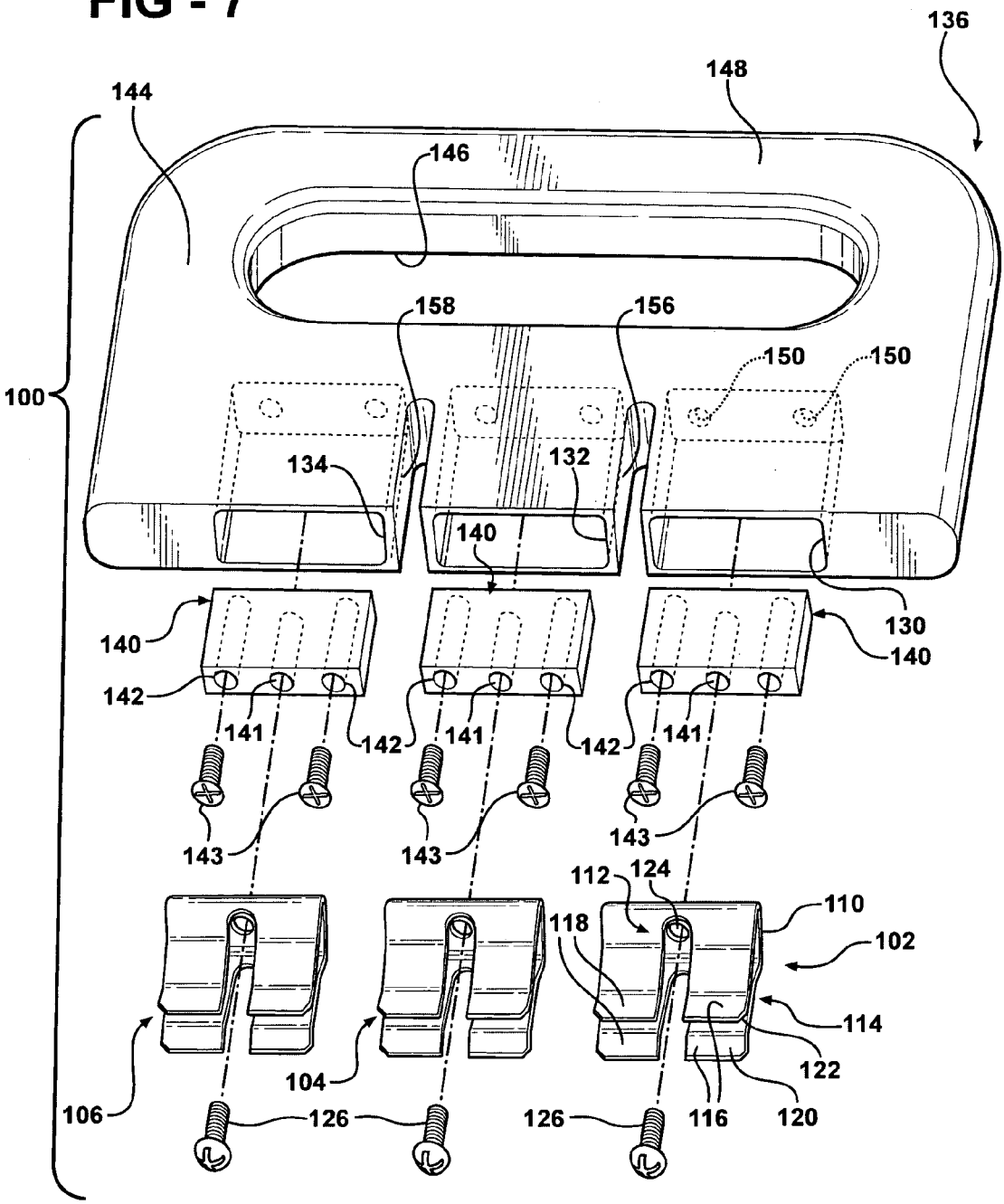
FIG. 7 is an exploded, perspective, partially broken away view of the jumper shown in FIGS. 5 and 6.

The terminal block jumper 100 includes, by example only, a plurality of jumper means 102, 104, and 106. The jumper means 102, 104, and 106 may be identically constructed and, as shown in FIGS. 6–9, each includes a spring jaw assembly formed of a base 110 and a pair of spaced spring jaw members 112 and 114 which unitarily extend from opposite side edges of the base 110 as shown in FIG. 7. The spring jaw members 112 and 114 may be split to form spaced contact portions 116 and 118, each having a contact point 120 spaced form an outer tip or end, one pair of spaced contact points 120 engaging one stud 36 as shown in FIG. 8. Each spring jaw member 112 and 114 has a resilient, bent shape, as shown in FIGS. 5–9.

Each spring jaw 102, 104, and 106 is formed of an electrically conductive material, such as copper, copper alloy, etc. Further, the contact points 120 of each spring jaw member 112 and 114 is nominally spaced apart a distance less than the outer diameter of the studs 36 on which each spring jaw 102, 104, and 106 is to be mounted. During such mounting, the spring jaw members 112 and 114 are forced outward thereby creating a spring tension force against the stud 36 which securely biases each jaw 102, 104, and 106 onto one stud 36 in a secure, electrical current carrying connection. At the same time, the spring force biasing the spring jaw members 112 and 114 toward each other does not damage the threaded studs 36 during plug-on or press-on connection to or the pull-off removal of the jumper 100 from the studs.

It will be understood that "jaw means" is meant to define a pair of spaced contacts which act together to engage a terminal or stud in an electrical power service apparatus, such as the socket shown in FIG. 1. The pairs of individual jaws forming each jaw means or jaw pair can be separate from adjacent pairs of jaw members forming an adjacent jaw means or pair, or integrally formed with one of the adjacent jaw members or the adjacent jaw pair as shown in FIG. 7.

An aperture 124 is formed in the base of each spring jaw 102, 104, and 106 for receiving a fastener 126 for mounting each spring jaw 102, 104, and 106 in a cavity or receptacle 130, 132, and 134 in a handle means 136. Other mounting means may also be employed.

One or more bores 150 may be formed in the bottom wall 152 of each cavity 130, 132 and 134 for receiving the fastener 126. Alternately, the fastener 126 may be a self-tapping fastener which forms the bore 150 as it is threaded through the bottom wall 152 and into the body 144 of the handle means 136.

An optional heat sink means, such as a bar or member 140, shown only in FIG. 7, may be disposed in contact with the base 110 of each jaw 102, 104, and 106 and mounted in the bottom wall of each cavity 130, 132, and 134 in the handle means 136 to remove heat from the respective jaws 102, 104, and 106 in order to maintain maximum current carrying capability for each spring jaw member 102, 104 and 106.

The heat sink means 140 may be in the form of a solid block of electrically conductive material, such as copper or copper alloy. In one mounting arrangement, described only by way of example, each heat sink bar 140 is formed with a generally centrally located bore 141, which may be threaded, and which receives a threaded fastener or a self tapping fastener 126 to secure each jaw means 106 to each heat sink 140.

A pair of threaded or smooth bores 142 are also formed in each heat sink member 140 and are disposed on opposite sides of the central bore 141. The bores 142 each receive a threaded fastener 143. The fasteners 143 extend through the bores 142 into additional bores 150 formed in the handle 136 to mount each heat sink 140 in the handle 146. In this manner, each jaw means 106 is fixedly attached to one heat sink 140 after the heat sink 140 has been fixed in one of the bores 130, 132 or 134 in the handle 136.

It will be understood that in applications where the heat sink means 140 is not employed, the fastener 146 may be used to directly mount each jaw means 106 in one cavity 130, 132 or 134 in the handle means 136.

The handle means 136, which may have a shape other than that shown by example in FIGS. 5–9, is formed of an electrically insulated material which may be constructed as a one-piece, molded body or two or more pieces joined together by adhesive, fasteners, etc. By example only, the handle means 136 is illustrated as having a unitary, one-piece body 144 formed of a molded, electrically insulating material. A finger grip aperture 146 is formed in the body 144 adjacent an outer end or hand grip 148 to facilitate manipulation of the terminal block jumper 100 into and out of connection with the studs 36, 162, 164 and 166 in the meter socket.

Slots 156 and 158 may be formed, by example only, between the outer walls of the jumper 100 forming the receptacles 130, 132, and 134.

Referring now to FIGS. 8 and 9, in use, the terminal block jumper 100 is positioned over the studs 36 and associated nuts 37 used to mount the line bus bars 30, 32, and 34 in the meter socket and the adjacent studs 162, 164, and 166 and nuts 168 of the bypass bars 70, 72, and 74, respectively. The utility service person firmly grasps the handle 136 by wrapping his or her fingers through the aperture 146 and around the end 148 and forces the spring jaws 102, 104, and 106 over adjacent pairs of line studs 36 and bypass studs 162, 164, and 166. This creates a bypass from the line bus bars 30, 32, and 34 to the bypass jumper bars 70, 72, and 74. Since the load bus bars in the meter socket are already jumpered to the opposite end of the bypass bars 70, 72, and 74, a bypass path is thereby formed between the line bus bars and load bus bars. This enables the meter to be safely removed from the socket without arcing.

The mounting of the terminal block jumper 100 on the studs is quick and safe since the service person's hand engages only the electrically insulating handle 136 and is shielded from the current carrying line bus bars and bypass jumpers. At the same time, the handle means 136 provides a gripping surface to facilitate a secure mounting of the terminal block jumper 100 on the studs in the meter socket.

After a new meter has been reinstalled in the meter socket, the utility person simply grasps the handle 136 and pulls the terminal block jumper 100 away from the socket thereby disengaging the spring jaw members 102, 104, and 106 from the studs 36, 162, 164, and 166. This disconnects the spring jaw members 102, 104 and 106 from the line bus bars. The meter is then connected between the line bus bars and the load bus bars in the meter socket.

Figure 10:
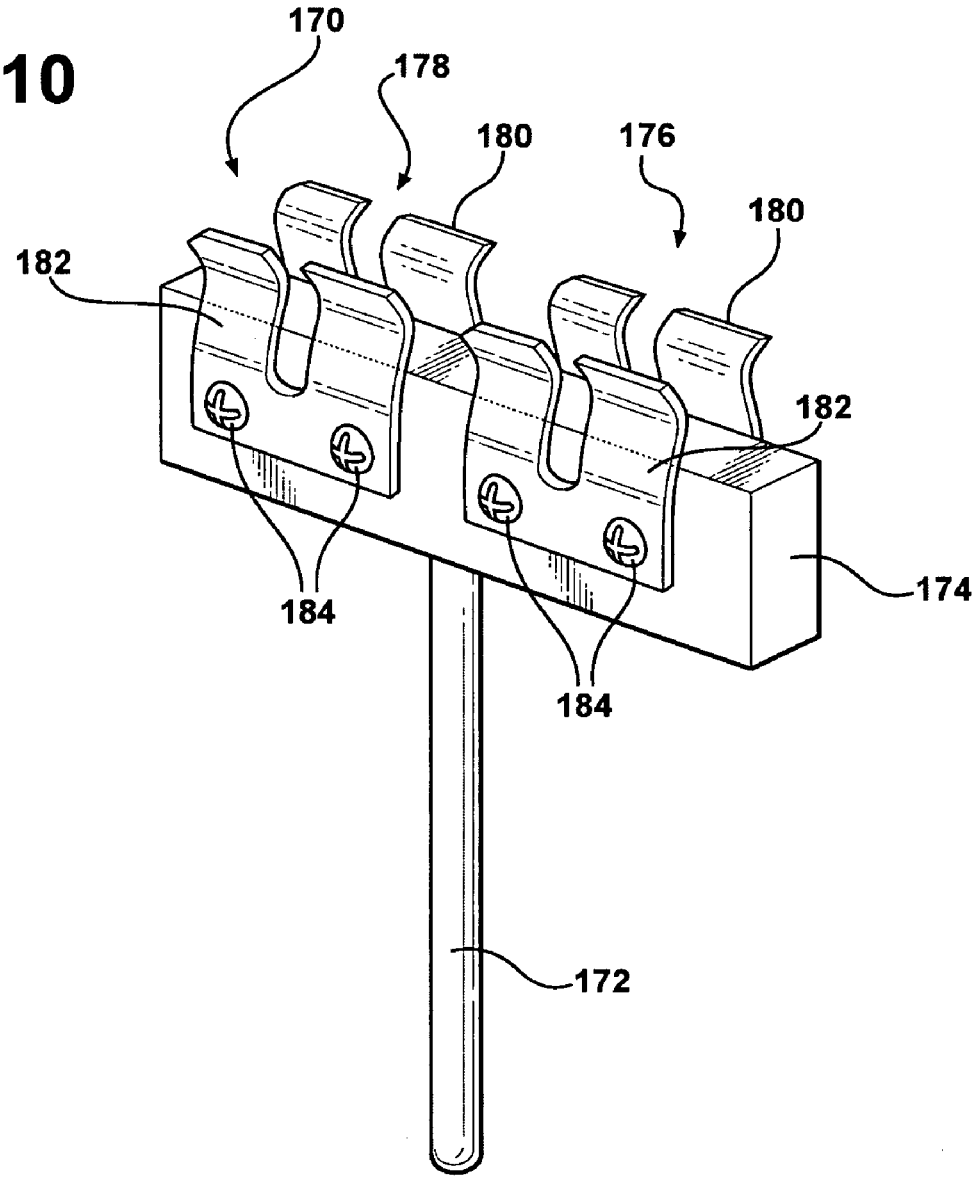
FIG. 10 is a perspective view of another aspect of a terminal block jumper.

Another aspect of a terminal block jumper 170 is shown in FIG. 10. The terminal block jumper 170 is configured for providing a jumper between a single line stud and a single bypass jumper stud. A handle means 72, which may be in the form of an elongated rod formed of electrically insulated material, is mounted by fasteners insert molding, etc., to a block 174 formed of an electrically conductive material. First and second spring jaws 176 and 178 are fixed to the bar 174. Each spring jaw 176 and 178 is formed of a pair of separate spring jaw members 180 and 182, respectively, which are fixed to the bar 174 by rivets or other fasteners 184. Each spring jaw member 180 and 182 has the resilient bent shape described above and shown in the spring jaw members 112 and 114.

Use of the terminal block jumper 170 is the same as that described above for the terminal block jumper 100 except that multiple terminal block jumpers 170 will be required for a polyphase meter socket.

Figure 12:
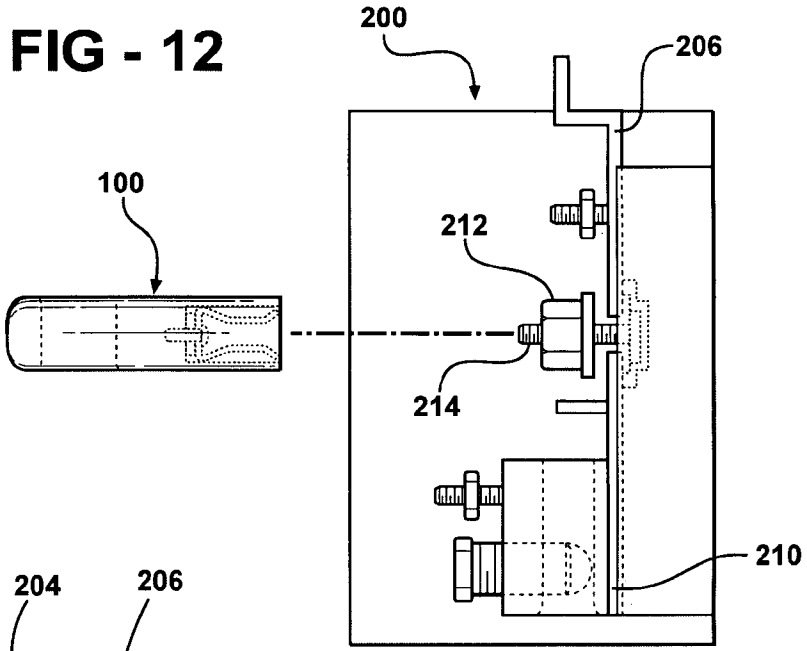
FIG. 12 is an exploded, side elevational view showing the mounting of the terminal block jumper of FIG. 5 in the socket of FIG. 11.
Figure 11B:
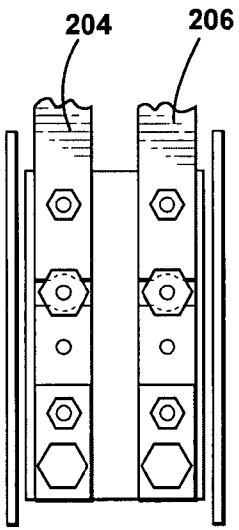
FIGS. 11A and 11B are partially enlarged and further enlarged, front elevational views of another aspect of a watthour meter socket which can employ the present terminal block jumper.
Figure 11A:
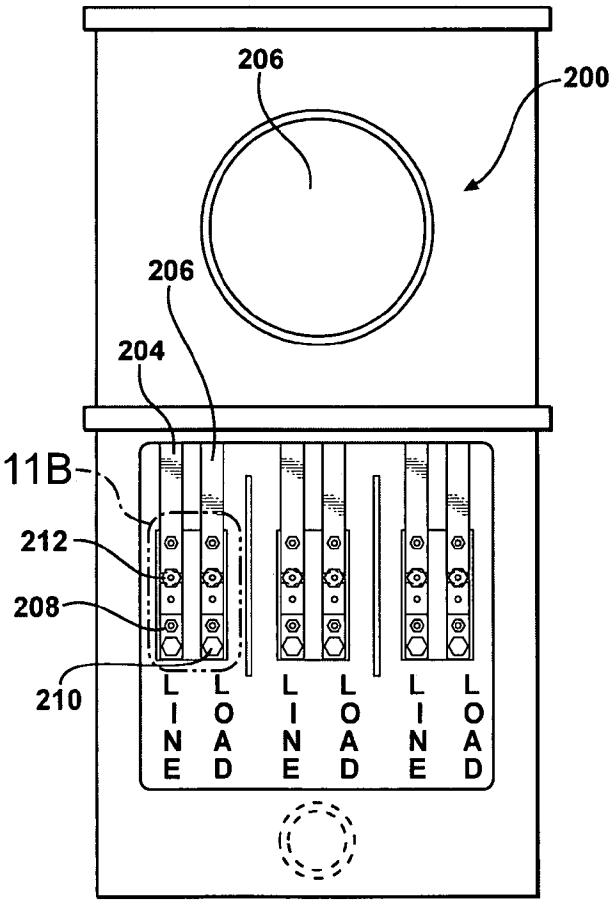

Referring now to FIGS. 11A, 11B and 12, there is depicted an alternate meter socket 200 in which the terminal block jumper 100 or 170 may also be employed. By example only, the meter socket 200 is an UECSC certified meter socket in which socket jaws for receiving a watthour meter 202 are connected to pairs of line and load bus bars 204 and 206 mounted in a bottom portion of the meter socket 200 below the meter 202. The line and load bus bars 204 and 206 alternate in pairs for each phase of meter power service.

Line and load power connections external to the meter socket 200 are connected to auxiliary bus bars 208 and 210. Each auxiliary line and load bus bar 208 and 210 is electrically connected to an associated meter bus bar 204 and 206 by a connecting nut 212 which is mounted over a stud 214 extending from the back plate of the meter socket 200. As shown in FIG. 12, the nut 212 forms a jumper or electrical connection between each associated line or load auxiliary bus bar and meter bus bar, such as the bus bars 206 and 210 as shown in FIG. 12.

The terminal block jumper 100, or the terminal block jumper 170, described above, may be mounted over adjacent studs 214 to provide a bypass jumper connection between each phase of line and load connections in the meter socket 200 to enable the meter 202 to be removed and a new meter reinstalled in the socket 200 in the same manner as described above.

In conclusion, there has been disclosed a unique terminal block jumper for use in meters having bypass jumper bars which provides a safe and quickly installable and removable jumper connection between the threaded studs on each line or load bus bar and its associated bypass jumper bar.

What is claimed is:

1. A jumper for an electric power service apparatus having at least one phase of electric power service and having spaced line and load power terminals and bypass terminals including threaded studs, the jumper comprising:

a plurality of electrical conductive jaws, each formed of a pair of resiliently movable spring jaw members coupled at one end thereof adapted for plug-on connection to two spaced threaded studs in the at least one phase of electric power service in an electric power service apparatus, each jaw associable with one distinct phase of a multi-phase electrical power service, the pairs of jaws arranged end to end.

2. The jumper of claim 1 wherein:

each jaw member includes at least two separate contact surfaces.

3. The jumper of claim 1 further comprising:

a handle for carrying the jaws.

4. The jumper of claim 3 further comprising:

a fastener for mounting the jaws in the handle.

5. The jumper of claim 4 wherein the handle comprises:

a body formed of electrically insulating material; and at least one cavity formed in the body and extending from an open end, at least one jaw mounted in the cavity.

6. The jumper of claim 5 wherein the handle further comprises:

a hand grip formed in the body for facilitating movement of the body.

7. The jumper of claim 5 further comprising:

a fastener for mounting each jaw in one of the at least one cavity in the body.

8. The jumper of claim 1 further comprising:

a handle including:

a body formed of an electrically insulating material;

a plurality of cavities formed in the body, each extending from an open end; and one jaw mounted in each of the cavities in the body.

9. The jumper of claim 8 further comprising:

a fastener mounting each jaw in one of the cavities in the body.

10. The jumper of claim 8 further comprising:

a hand grip carried on the body facilitating manipulation of the body.

11. A jumper for an electric power service apparatus having spaced line and load terminals including threaded studs, the jumper comprising:

interconnected electrical conductive jaws adapted for plug-on connection to at least two spaced threaded studs in an electric power service apparatus;

a handle for carrying the jaws;

a fastener mounting each jaw in the handle, the handle including:

a body formed of electrically insulating material;

at least one cavity formed in the body and extending from an open end; and at least one jaw mounted in the cavity; and a heat sink mounted in electrical contact with the jaws, the heat sink removing heat from the jaws during electric current flow through the jaws.

12. A jumper for an electric power service apparatus having spaced line and load terminals including threaded studs, the jumper comprising:

interconnected electrical conductive jaws adapted for plug-on connection to at least two spaced threaded studs in an electric power service apparatus;

each jaw including a pair of resiliently movable spring jaw members coupled at one end; and an electrically conductive member, the jaws mounted on the electrically conductive member.

13. The jumper of claim 12 further comprising:

a handle, coupled to the electrically conductive member, for facilitating manipulation of the jumper.

14. The jumper of claim 13 further comprising:

the handle mounted on and extending from the electrically conductive member.

15. A method of temporarily connecting two threaded studs in an electrical power service apparatus used to receive fasteners to secure line and load power conducting members, the method comprising the step of:

plug-on engaging an electrically conductive jumper with two spaced, resilient electrically conductive jaws to both threaded studs.

16. The method of claim 15 further comprising the steps of:

using one of the two threaded studs to mount one of a line bus bar and a load bus bar and another one of the two threaded studs to mount a bypass member in a meter socket.

17. The method of claim 15 further comprising the steps of:

providing line and load conductors in a socket connected to socket jaw contacts;

arranging a line conductor and a load conductor of the same electrical phase adjacent to each other;

providing line and load distribution network conductors adjacent to and respectively spaced from ends of the line and load conductors of each phase of electrical service;

providing the threaded studs between the spaced ends of the line and load power distribution network conductors and the line and load conductors in the socket;

providing a fastener engagable with the threaded studs, to electrically connect the line conductors to the line distribution network conductors and the load conductors to the load distribution network conductors for each phase of electrical power service; and installing the jumper over the threaded studs connecting the line and load conductors and the power distribution conductors in each phase of the electrical power service.

18. The method of claim 15 further comprising the step of: providing a handle, coupled to the jaws, for manipulating the jumper.

19. A jumper for an electrical power service apparatus having spaced line and load terminals including threaded studs, the jumper comprising:

a body carrying interconnected electrical conductive jaws adapted for plug-on connection to at least two spaced threaded studs in an electrical power service apparatus; and heat sink means, mounted in electrical contact with the jaws, for removing heat from the jaws during electrical current flow through the jaws.

* * * * *